US005123763A

United States Patent [19]

Simmons

[11] Patent Number: 5,123,763

[45] Date of Patent: Jun. 23, 1992

[54] WHEEL LUG CLEANING TOOL

[76] Inventor: Billy C. Simmons, 10980 Village Rd., Moreno Valley, Calif. 92557

[21] Appl. No.: 729,179

[22] Filed: Jul. 12, 1991

[51] Int. Cl.[5] ..... A47L 25/00; A47L 13/17

[52] U.S. Cl. ..... 401/9; 15/104.1 R; 15/104.04; 401/10; 401/11; 401/176

[58] Field of Search ..... 401/176, 9, 10, 11, 401/186; 15/104.1 R, 104.04

[56] References Cited

U.S. PATENT DOCUMENTS

| | | | |
|---|---|---|---|
| 2,404,507 | 7/1946 | Link | 15/104.04 X |
| 2,629,121 | 2/1953 | Petre | 15/104.1 R X |
| 3,087,189 | 4/1963 | Scanlon | 401/11 |
| 3,196,886 | 7/1965 | Brown | 401/186 |
| 3,811,783 | 5/1974 | Johnson | 401/10 X |
| 4,117,566 | 10/1978 | Ward | 15/210 R X |
| 4,225,253 | 9/1980 | Fraleigh | 401/9 |
| 4,862,549 | 9/1989 | Criswell et al. | 15/104.1 R X |

FOREIGN PATENT DOCUMENTS

| | | | |
|---|---|---|---|
| 657920 | 1/1929 | France | 401/176 |

*Primary Examiner*—Steven A. Bratlie
*Attorney, Agent, or Firm*—Leon Gilden

[57] ABSTRACT

A cleaning tool for the removal of debris and subsequent cleaning of lug nuts for a wheel includes an elongate handle removably mounted to a socket, wherein the socket includes a cylindrical or alternatively, a conical configuration to receive an associated lug nut therewithin. Rotation of the socket effects a cleaning of an associated lug nut.

1 Claim, 4 Drawing Sheets

WHEEL LUG CLEANING TOOL

BACKGROUND OF THE INVENTION

1. Field of the Invention

The field of invention relates to cleaning apparatus, and more particularly pertains to a new and improved wheel lug cleaning tool wherein the same provides use in an automotive environment.

2. Description of the Prior Art

Tools in the prior art directed to cleaning and the like defining a socket for example include U.S. Pat. No. 2,713,693 to Johnson wherein a fingernail polish remover includes a generally cylindrical socket to receive an individual's finger therewithin, with a rotary handle to effect rotation of the socket relative to the fingernail to be cleaned.

U.S. Pat. No. 2,744,279 to Heber sets forth a screw threaded plug-like member receiving a cloth thereabout directed into an opening for a bowling ball to effect cleaning of a finger openings within said bowling ball.

U.S. Pat. No. 2,832,245 to Burrows sets forth a sponge-like insert within a socket member for receiving a spark plug therewithin to grip the spark plug in removal from an automotive engine.

U.S. Pat. No. 4,117,566 to Ward sets forth a vehicular lug nut cleaning device defining a sponge body mounted fixedly to a rearwardly extending handle longitudinally aligned with the body defining a socket receiving for receiving a lug nut therewithin.

As such, it may be appreciated that there continues to be a need for a new and improved wheel lug cleaning tool as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of cleaning apparatus now present in the prior art, the present invention provides a wheel lug cleaning tool wherein the same is arranged to define a conically configured socket to receive a lug nut therewithin for effecting enhanced cleaning of an associated lug nut relative to an automotive wheel. As such, the general purpose of the present invention, which will be described subsequently in greater detail, is to provide a new and improved wheel lug cleaning tool which has all the advantages of the prior art cleaning apparatus and none of the disadvantages.

To attain this, the present invention provides a cleaning tool for the removal of debris and subsequent cleaning of lug nuts for a wheel including an elongate handle removably mounted to a socket, wherein the socket includes a cylindrical or alternatively, a conical configuration to receive an associated lug nut therewithin. Rotation of the socket effects a cleaning of an associated lug nut.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wheel lug cleaning tool which has all the advantages of the prior art cleaning apparatus and none of the disadvantages.

It is another object of the present invention to provide a new and improved wheel lug cleaning tool which may be easily and efficiently manufactured and marketed.

It is a further object of the present invention to provide a new and improved wheel lug cleaning tool which is of a durable and reliable construction.

An even further object of the present invention is to provide a new and improved wheel lug cleaning tool which is susceptible of a low cost of manufacture with regard to both materials and labor, and which accordingly is then susceptible of low prices of sale to the consuming public, thereby making such wheel lug cleaning tools economically available to the buying public.

Still yet another object of the present invention is to provide a new and improved wheel lug cleaning tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
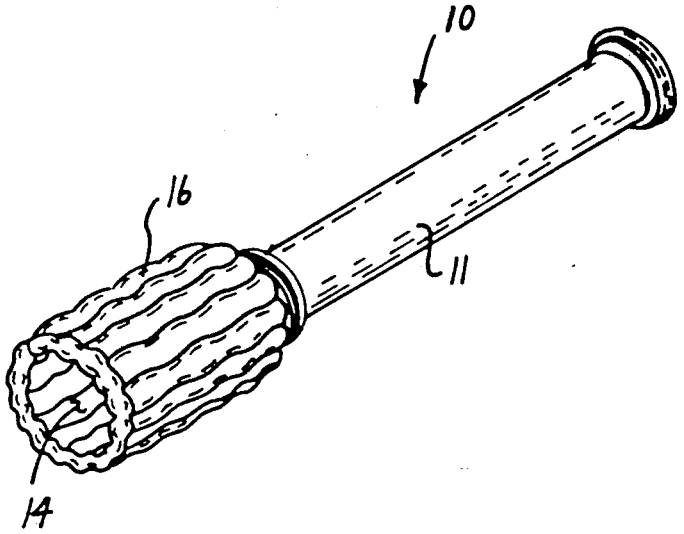
FIG. 1 is an isometric illustration of the instant invention.
Figure 2:
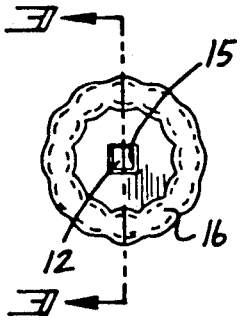
FIG. 2 is an orthographic end view of the instant invention.
Figure 3:
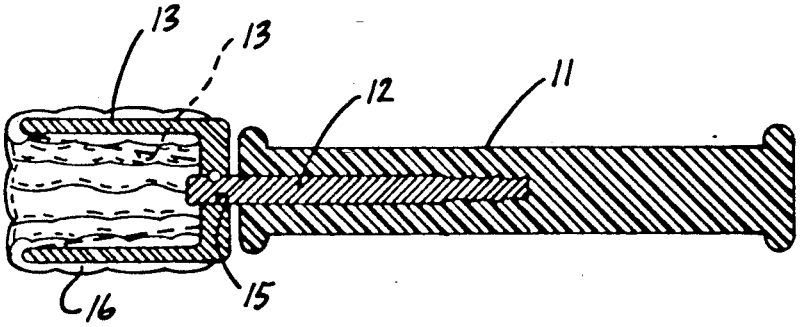
FIG. 3 is an orthographic cross-sectional illustration, taken along the lines 3—3 of FIG. 2 in the direction indicated by the arrows.

With reference now to the drawings, and in particular to FIGS. 1 to 8 thereof, a new and improved wheel lug cleaning tool embodying the principles and concepts of the present invention and generally designated by the reference numerals 10, 10*a*, and 10*b* will be described.

More specifically, the wheel lug cleaning tool 10 of the instant invention essentially comprises an elongate coaxially aligned handle 11 that includes a handle mounting shaft 12 coaxially directed through the handle extending forwardly thereof in a coaxially aligned relationship to permit selective securement within a square drive bore 15 coaxially directed through a floor of an associated lug receiving socket 13. The lug receiving socket 13 may define cylindrical or a truncated conical interior cavity to receive a wheel lug therewithin. The conical cavity is at times advantageous to accommodate various sizes of lug nuts and effect greater frictional interrelationship between the associated walls of the socket and a fibrous covering 16 that is mounted about interior and exterior surfaces of the side walls of the socket 13 to effect cleaning and polishing of the lug nut received within the cavity 14. The covering is positioned on exterior surfaces of the side walls of the socket 13 to provide for a cleaning surface that is readily manually manipulated about a lug nut to effect access to portions of a lug nut that may not be readily available when directed interiorly of the socket 13 within the cavity 14. The square drive bore 15 removably mounted relative to the shaft 12 permits selective securement of the socket 13 to various drive tools, such as socket wrenches and the like, should enhanced speed be desired in a cleaning procedure.

Figure 4:
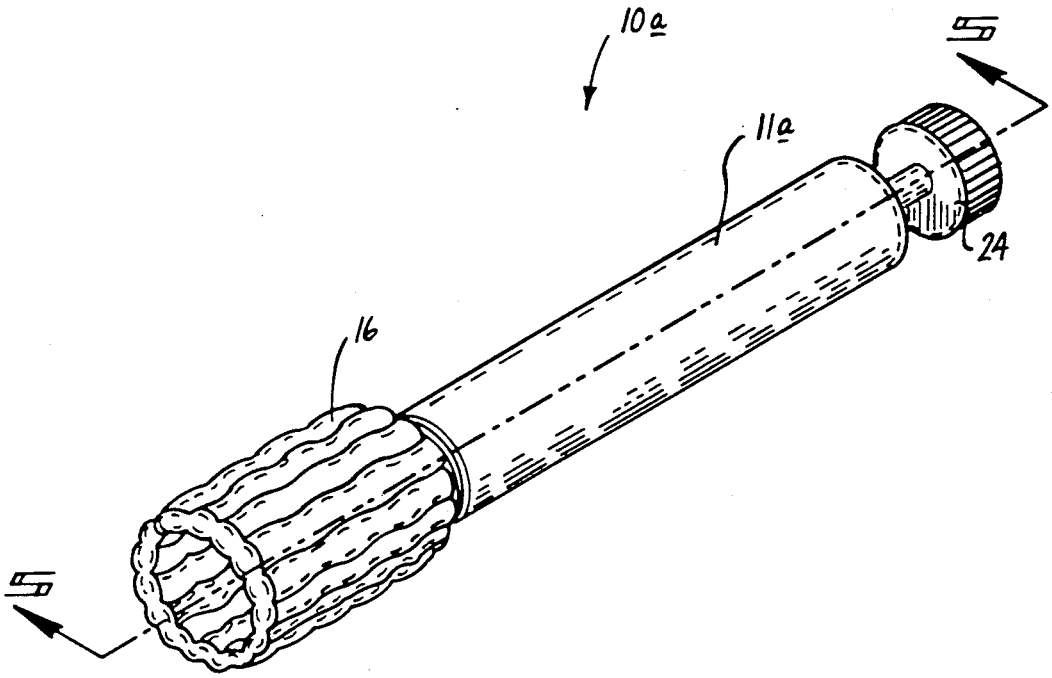
FIG. 4 is an isometric illustration of a modification of the invention.
Figure 5:
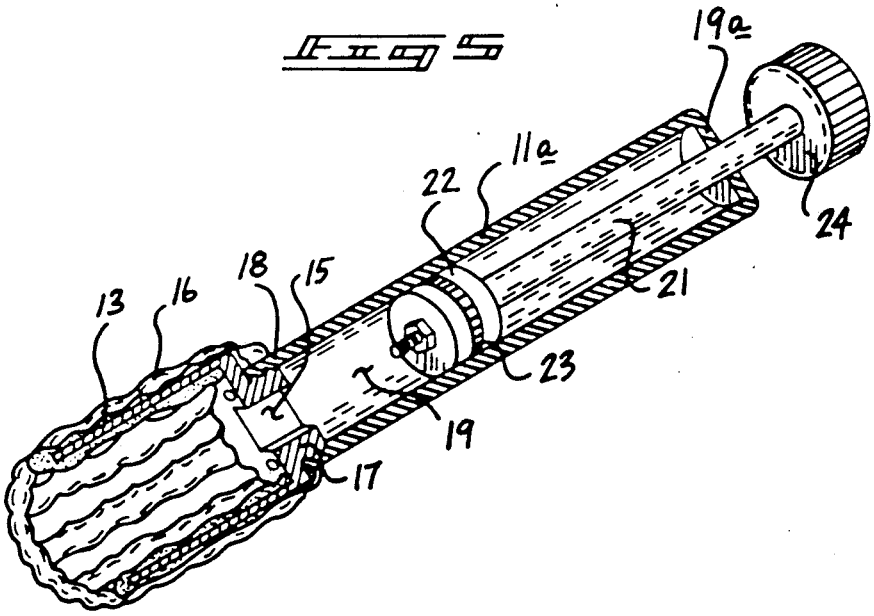
FIG. 5 is an orthographic view, taken along the lines 5—5 of FIG. 4 in the direction indicated by the arrows.

FIGS. 4 and 5 illustrate a modified cleaning tool 10*a*, wherein a modified handle 11*a* includes an internally threaded upper handle end 18 that is threadedly secured to an externally threaded socket shank 17 coaxially aligned with the socket 13 that may also be formed with conical walls, as desired and noted above, with the socket shank 17 extending rearwardly thereof. The modified handle 11*a* includes a piston rod 21 reciprocatably directed through a handle lower web 19*a* that is orthogonally oriented relative an axis defined by the handle, including a coaxial bore to receive the piston rod 21 slidably therethrough. A piston 22 is mounted fixedly and orthogonally to an upper terminal end of the piston rod 21 and includes a piston rod annular seal 23 formed thereabout to provide a sealing relationship between an interior wall surface of the cylindrical handle 11*a*, wherein a reservoir chamber 19 is defined between a forward terminal end of the piston 22 and the bore 15 to direct fluid from the reservoir 19 therethrough into the cavity 14, wherein the fluid may be of a cleaning fluid solution or polishing fluid to enhance cleaning in a lug cleaning procedure. The piston rod includes a piston rod handle 24 mounted fixedly and orthogonally to an outer terminal end of the rod 21 as it projects exteriorly of the lower web 19*a* to permit ease of manipulation of the piston rod 21.

Figure 6:
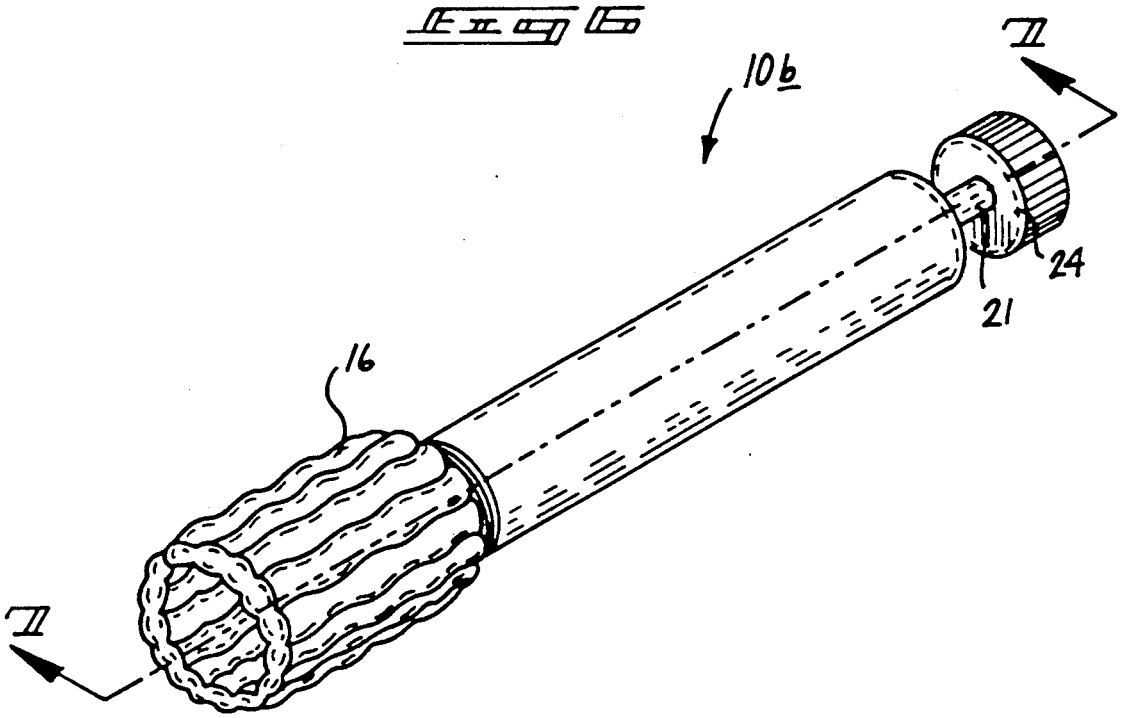
FIG. 6 is an isometric illustration of a further modified aspect of the invention.
Figure 7:
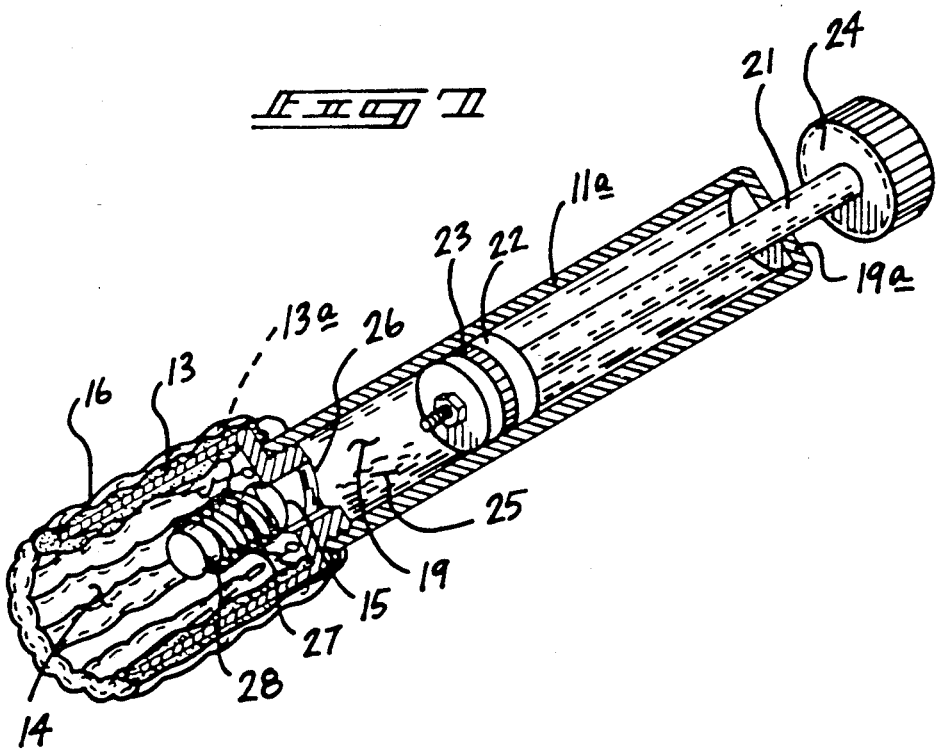
FIG. 7 is an orthographic view, taken along the lines 7—7 of FIG. 6 in the direction indicated by the arrows.
Figure 8B:
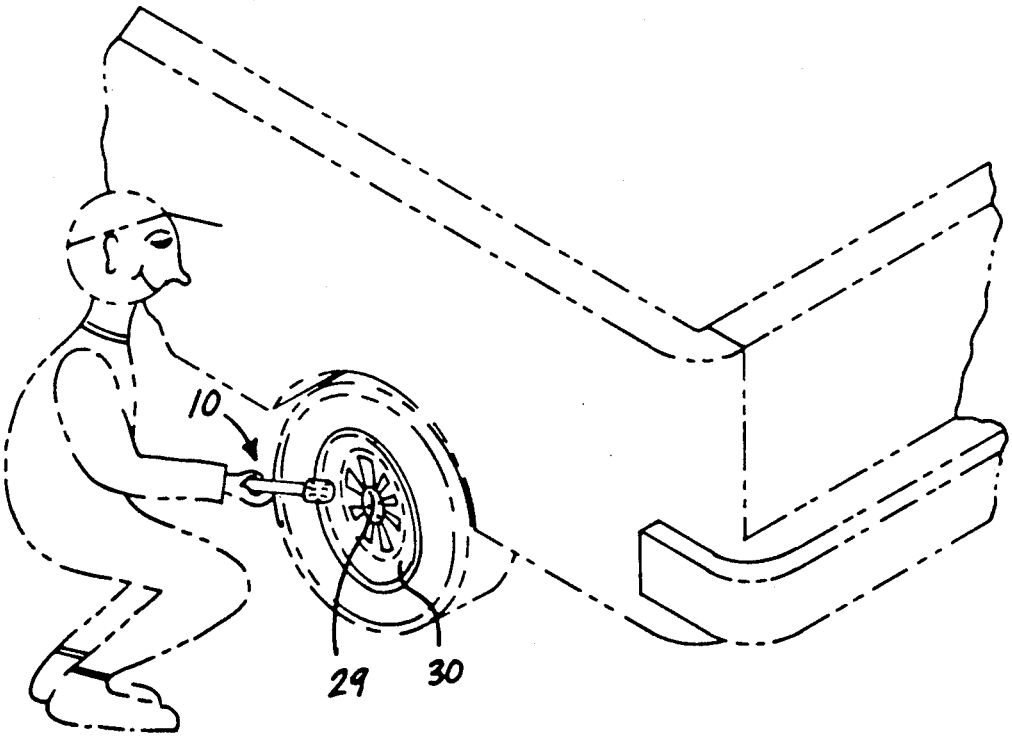
FIG. 8 is an isometric illustration of the invention in use.

A further modified tool 10*b*, as illustrated in FIGS. 6 and 7, where additionally to the organization, a resilient flap valve 26 is positioned within the bore 15 to maintain the cleaning fluid 25 within the reservoir 19 until the valve 26 is deflected upon pressurizing of the reservoir 19 by projecting of the piston 22 interiorly of the reservoir 19 and thereby direct the cleaning fluid interiorly within the cavity 14. A spring 27 is coaxially mounted within the cavity 14, including a magnet 28 mounted at a forward terminal end thereof and is coaxially aligned within the cavity 14 to thereby permit selective securement of the lug nut to the magnet 28, with the spring permitting compression thereof to enhance mounting of a lug nut onto an associated lug nut stud (not shown) of an associated automotive wheel, wherein the spring 27 is coaxially retracted within the socket 14 upon compression of the spring 27, with the walls 13 defining a conical interior cavity defined by the modified wall 13*a*, as illustrated in FIG. 7, to enhance grasping of the lug nut for its mounting upon an associated lug nut stud and thereby permit subsequent cleaning and mounting of the lug nut in a single procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wheel lug cleaning tool, comprising, an elongate coaxially aligned handle, the handle defining a cylindrical configuration formed about a central axis, and a lug receiving socket, the lug receiving socket including a conical wall defining a truncated conical interior cavity, and the socket including a socket rear wall, the socket rear wall orthogonally oriented relative to a socket axis defined by the socket cavity, and the socket rear wall including a square bore directed coaxially therethrough for receiving a driving tool therewithin, and mounting means formed on the socket rear wall for selective securement of the socket rear wall to a forward terminal end of the handle, and wherein the mounting means includes a socket shank projecting rearwardly and coaxially of the socket rear wall, with the socket shank including the square bore directed therethrough, the socket shank including an externally threaded surface orthogonally oriented relative to the socket rear wall, and the forward terminal end of the handle including an internally threaded handle portion for selective securement to the socket shank, and wherein the socket includes a fibrous covering formed coextensively about the interior and exterior surfaces of a side wall defining the socket cavity, and wherein the handle includes a handle rear terminal end, the handle rear terminal end including a handle lower web, the handle lower web including a coaxial bore directed therethrough, and a piston rod slidably and coaxially mounted through the bore, the piston rod including a piston handle positioned exteriorly of the handle lower web, and a piston orthogonally and fixedly mounted to a forward terminal end of the piston rod interiorly of the handle, and an annular piston seal formed about the piston rod in contiguous communication with an interior surface of the handle, the handle defining a cylindrical interior cavity, the cylindrical interior cavity defining a reservoir between the piston and the socket shank, and wherein the square bore includes a resilient flap valve mounted within the square bore, wherein the flap valve is deflected upon projection of the piston and piston rod interiorly of the handle, and including a coil spring coaxially mounted interiorly of the socket cavity projecting interiorly thereof, with the coil spring including a permanent magnet mounted coaxially aligned within the socket cavity for securement of a lug nut thereon.

* * * * *